US006352662B1

(12) United States Patent
Murphy et al.

(10) Patent No.: US 6,352,662 B1
(45) Date of Patent: Mar. 5, 2002

(54) INTEGRAL MOLDED GRIP AND SHAFT

(75) Inventors: James M. Murphy, Oceanside; Herb Reyes, Laguna Niguel, both of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/378,979

(22) Filed: Aug. 23, 1999

Related U.S. Application Data

(62) Division of application No. 08/920,022, filed on Aug. 26, 1997, now Pat. No. 5,947,836.

(51) Int. Cl.[7] ..... B29C 49/22; B29C 70/44

(52) U.S. Cl. ..... 264/129; 264/132; 264/162; 264/257; 264/258; 264/314; 425/389

(58) Field of Search ..... 264/257, 258, 264/314, 134, 135, 516, 132, 129, 162; 425/389

(56) References Cited

U.S. PATENT DOCUMENTS

| | | | | |
|---|---|---|---|---|
| 1,418,038 A | | 5/1922 | Tousey | |
| 2,150,737 A | | 3/1939 | Chittick | |
| 3,614,101 A | | 10/1971 | Hunter | |
| 4,097,626 A | | 6/1978 | Tennett | |
| 4,132,579 A | | 1/1979 | Vanauken | |
| 4,135,035 A | | 1/1979 | Branen | |
| 4,319,750 A | | 3/1982 | Roy | |
| 4,660,832 A | | 4/1987 | Shomo | |
| 4,757,997 A | | 7/1988 | Roy | |
| 4,765,856 A | | 8/1988 | Doubt | |
| 4,819,939 A | | 4/1989 | Kobayashi | |
| 4,836,545 A | | 6/1989 | Pompa | |
| 4,919,420 A | | 4/1990 | Sato | |
| 4,962,608 A | | 10/1990 | Loomis | |
| 5,083,780 A | | 1/1992 | Walton et al. | |
| 5,093,162 A | | 3/1992 | Fenton | |
| 5,156,396 A | | 10/1992 | Akatsuka | |
| 5,158,289 A | | 10/1992 | Okumoto | |
| 5,178,711 A | | 1/1993 | Lu | |
| 5,253,867 A | | 10/1993 | Gafner | |
| 5,277,423 A | * | 1/1994 | Artus | 273/80 R |
| 5,298,211 A | | 3/1994 | Hamanaka | |
| 5,317,828 A | * | 6/1994 | Yasui | 43/18.5 |
| 5,324,032 A | | 6/1994 | Minami | |
| 5,348,777 A | | 9/1994 | Oonuki | |
| 5,421,574 A | | 6/1995 | Yamagishi et al. | |
| 5,427,373 A | * | 6/1995 | Kusumoto | 273/80 R |
| 5,569,098 A | | 10/1996 | Klein | |
| 5,599,242 A | | 2/1997 | Solviche | |
| 5,620,380 A | * | 4/1997 | Tennet et al. | 473/319 |
| 5,626,529 A | * | 5/1997 | Roy | 473/319 |
| 5,645,668 A | * | 7/1997 | Lin et al. | 156/175 |
| 5,653,644 A | | 8/1997 | Jaeckel | |
| 5,692,970 A | * | 12/1997 | Nelson | 473/318 |
| 5,695,408 A | | 12/1997 | Delacruz | |
| 5,730,669 A | * | 3/1998 | Huang | 473/549 |
| 5,735,752 A | | 4/1998 | Antonious | |
| 5,755,826 A | * | 5/1998 | Beach et al. | 473/316 |
| 5,792,551 A | * | 8/1998 | Miyao | 428/304.4 |
| 5,814,268 A | * | 9/1998 | Banchelin et al. | 264/516 |
| 5,913,709 A | * | 6/1999 | Cyr et al. | 446/418 |
| 6,071,460 A | * | 6/2000 | Renaudin et al. | 264/314 |

* cited by examiner

*Primary Examiner*—Jan H. Silbaugh
*Assistant Examiner*—Stefan Staicovici
(74) *Attorney, Agent, or Firm*—Michael A. Catania

(57) ABSTRACT

A composite shaft having an integral grip. The shaft comprises a plurality of plies of pre-preg composite sheet molded into a tubular shaft body. The shaft body has a grip directly molded on one end which may include a grip geometry and/or an ornamental pattern. To manufacture the shaft, plies of pre-preg may be wrapped around a bladder-covered mandrel in a predetermined manner and placed in a mold. The mold defines a cavity including, if desired, a selected grip geometry and/or ornamental design. The bladder is inflated, forcing the plies of pre-preg against the wall of the mold, and the mold is heated for a selected time to cure the plies. The grip of the shaft may be covered with a light coating material, providing a rubber-like feel.

1 Claim, 1 Drawing Sheet

INTEGRAL MOLDED GRIP AND SHAFT

CROSS REFERENCES TO RELATED APPLICATIONS

This application is a divisional application of co-pending U.S. patent application Ser. No. 08/920,022, filed on Aug. 26, 1997 is now U.S. Pat. No. 5,947,836.

STATEMENT REGARDING FEDERALLY SPONSORED RESEARCH OR DEVELOPMENT

Not Applicable

BACKGROUND OF THE INVENTION

1. Field of the Invention

The present invention relates generally to tubular shafts manufactured from composite materials and, more particularly, to composite shafts for golf clubs and other articles.

2. Description of the Related Art

Recently, substantial attention has been directed toward the development of lightweight tubular shafts for golf clubs and other articles such as fishing rods. Such shafts are commonly manufactured from sheets of composite materials, including, for example, various forms of "pre-preg." Pre-preg composite sheets are formed by pulling strands of fiber, for example, carbon or glass fiber, through a resin solution and allowing the resin to partially cure. Exemplary resins or "binding matrices" may include, for example, thermoset epoxy resins and thermoplastic resins. Alternatively, pre-preg sheets may be manufactured by pulling a fabric or weave of composite fiber through a resin solution and allowing the resin to partially cure. In either case, once the resin is partially cured or "staged," the resin holds the fibers together such that the fibers form a malleable sheet When using pre-preg sheets, shafts generally may be manufactured by wrapping a set of plies of pre-preg composite sheet around a mandrel in a predetermined manner, wrapping the ply-wrapped mandrel in a binding material such as cellophane or polypropylene tape, and heating the ply-wrapped mandrel to a predetermined temperature for a time sufficient to allow the resin in the pre-preg composite sheets to become fully cured. Once the resin has been fully cured, the binding material may be removed from the exterior of the shaft, and the mandrel may be removed from the core of the shaft.

Alternatively, a set of plies of pre-preg composite sheet may be wrapped around a bladder covered mandrel, and placed in a mold. If desired, the mandrel may be removed leaving the bladder and plies in the mold, or the mandrel may be left in the mold. In either case, the bladder may be inflated to a predetermined pressure to force the plies of pre-preg against the walls of the mold, and the mold may be heated to a predetermined temperature for a time sufficient to allow the resin in the pre-preg composite sheets to completely cure. Once the resin has been cured, the cured plies (shaft) and mandrel may be removed from the mold, and the bladder (and mandrel if not previously removed) may be removed from the shaft. The resulting shaft may then be used to manufacture such articles as golf clubs and fishing poles.

When assembling golf clubs or fishing poles, a handle or grip, made from rubber, leather, cork or similar materials, generally will be placed on one end of the shaft. Such grips generally provide a tacky or slip-resistant surface which enables a person to securely grasp the golf club or fishing rod and minimizes the likelihood that the golf club or fishing rod will slip out of or change position within the person's hands during use.

Often, the grip provided may comprise a substantially cylindrical sleeve having an open end and a substantially closed end. The sleeve is introduced over the end of the shaft and extends longitudinally over a portion of the shaft such that the closed end of the grip engages the end of the shaft. The grip generally may be fixed on the shaft by friction and/or through the use of conventional adhesives or adhesive tapes.

Alternatively, a wrapped tape grip may be used. Rubber or similar tape material, commercially available in rolls and possibly having a backing adhesive, may be helically wound over the end of a shaft. Then, a cap may be placed over the end of the shaft, holding the end of the tape and keeping it from potentially unwinding.

Conventional grips, however, may add substantial and undesired weight to the shaft overall, or may add weight in a location that is not optimal for the design of a particular article. For example, in the case of golf clubs it is sometimes a goal to substantially reduce the overall weight of a shaft, or to move weight from an end of the shaft to another location. Weight reduction or weight shifting in a golf club shaft is limited, however, by the need to provide a grip on the end of the shaft, with traditional grips adding between about 45–50 grams to the weight of the shaft, and ultra-light grips adding about 20 grams.

Accordingly, it is believed that those in the field of golf club design would find a substantially reduced weight grip that is both durable and economical to manufacture to be quite useful. It is also believed that methods of forming a reduced weight grip on the end of a shaft for a golf club would be found to be useful.

BRIEF SUMMARY OF THE INVENTION

The present invention is directed to improved shaft grip structures for use with golf clubs, fishing rods, and other articles of manufacture. In one innovative aspect, a grip formed from composite materials forms an integral grip portion of a proximal region of a shaft. If desired, the grip may have a predetermined geometry and/or an ornamental pattern formed thereon.

To manufacture a shaft with an integral grip in accordance with the present invention, a first set of plies of pre-preg composite sheet is selected and used to form the overall body of a shaft. Another set of plies of pre-preg may be selected to be included in the grip region of the shaft. For example, lower modulus, toughened plies may be used to form the integral grip portion of the shaft. This may result in the provision of a softer cured material for the grip which creates a more comfortable, rubber-like feel.

A resin film, possibly including reinforcing fibers, also may be added to the grip region. Films using Inter Penetrating Networks (IPNs) or similar resins, such as rubber, urethane, or epoxy films, may be used in the grip region so that the resulting grip has a soft, yet tacky, feel when cured. Most preferably, a resin film of ethylene propylene diene monomer (EPDM) copolymer is applied to the first set of plies of pre-preg and co-molded using the process described below.

Once the materials comprising the shaft have been selected, a molding process may be used to form the shaft. The molding process preferably includes a single curing step in which the composite materials of the overall shaft body and the composite materials and/or resin film of the grip are simultaneously shaped and cured. Stated differently, the composite materials of the shaft body and those of the grip are co-molded or co-cured. For such a molding process, a conventional mandrel having predefined dimensions is selected and covered by a latex sheath or bladder. Plies of pre-preg composite sheet and resin film may be wound around the mandrel in a predetermined manner, and the wrapped mandrel may be placed in a mold. The mold generally will include a cavity having a predefined shape for the shaft and grip region, and the shape of the cavity corresponding to the grip region may be shaped for applying a predetermined grip geometry and/or ornamental design to the grip region of the shaft.

If desired, the mandrel may be removed, leaving the sheath and surrounding plies in the mold. Alternatively, the mandrel may remain in the mold during the curing process. Pressurized gas may then be introduced to inflate the bladder and force the plies of pre-preg and resin film against the wall of the mold. The mold may then be heated for a selected period of time, that is, a time sufficient to allow proper curing of the resin comprising the various plies. Thereafter, the shaft may be removed from the mold, and the latex sheath (and mandrel if not already removed) may be removed from the core of the shaft.

The cured composite material and co-molded resin film may provide a substantially finished surface for the shaft, although preferably the grip region will be coated using a light coating material, such as Durasoft manufactured by Akzo Nobel of Troy, Mich., which may provide additional comfort, vibration dampening and/or slip resistance. Preferably, in addition to having a resin matrix film co-molded with the shaft, the grip region of the shaft body may be coated typically by dipping or spraying the coating onto the surface of the grip.

While conventional grips for golf clubs weigh on average between about 20 and 50 grams, the integrally molded grip of the present invention may reduce this weight to less than about 5–8 grams. Thus, where conventional composite golf clubs may weigh about 300 grams, similar clubs including a shaft in accordance with the present invention may achieve weights as light as approximately 255 grams. Alternatively, using a grip in accordance with the present invention it may be possible to redistribute as much as 45 grams of mass within the length of a conventional composite golf club shaft. Somewhat smaller, though still significant, reductions or redistributions of mass (on the order of 15 grams) may be achieved in the case of ultra-light shafts.

Accordingly, a principal object of the present invention is to provide a shaft for a golf club, a fishing rod or other article of manufacture that has a grip directly molded thereon, eliminating the need for conventional grips, and to provide methods of manufacturing such shafts.

It is also an object of the present invention to provide a golf club shaft having a substantially reduced weight relative to golf club shafts using conventional grips.

It is still another object of the present invention to provide a means for reducing the mass associated with a grip for a golf club shaft and for distributing additional mass within the length of the golf club shaft.

It is a further object of the present invention to provide a shaft that includes an integrally molded grip that substantially reduces the likelihood that the grip will separate from the shaft during the life of a golf club.

It is an additional object of the present invention to provide a golf club shaft having a desired grip geometry, optionally including an ornamental design, molded directly onto the shaft itself, and to provide methods of manufacturing such shafts.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
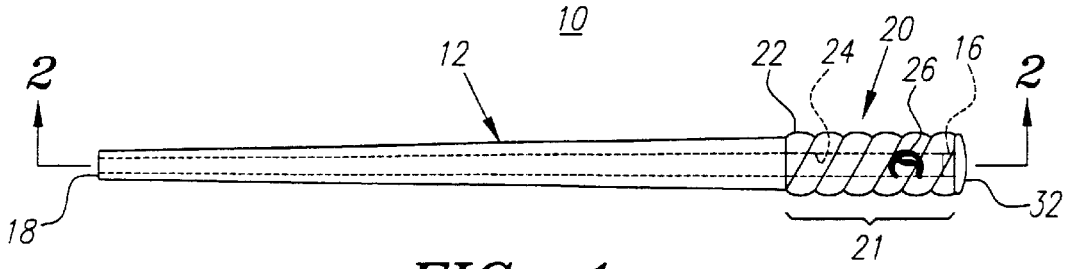
FIG. 1 is a side view of a preferred embodiment of a shaft in accordance with the present invention.

Turning now to the drawings, a composite shaft 10 having an integral grip 20 is shown in FIG. 1. The shaft 10 comprises a substantially rigid shaft body 12 having a proximal end 16 and a distal end 18. The shaft body 12 generally has the shape of a gradually tapered cylindrical tube, although alternatively the shaft body 12 may have a substantially uniform cross-section, a flared tip, or numerous other configurations.

A proximal region 21 of the shaft body 12 comprises a grip 20. The grip 20 may have a predetermined grip geometry 24 and an ornamental pattern 26, and is preferably manufactured using the molding process described more particularly below. The grip geometry 24 may include any desired configuration that provides a comfortable gripping surface for holding the shaft, such as a raised (or alternatively recessed) helical grip pattern shown in FIG. 1. In addition, the outer surface 22 optionally may have an ornamental pattern 26 embossed (or alternatively imprinted) onto it. The pattern may include a letter or word, such as the name of a manufacturer, or a design, such as a logo identifying the manufacturer.

Figure 2:
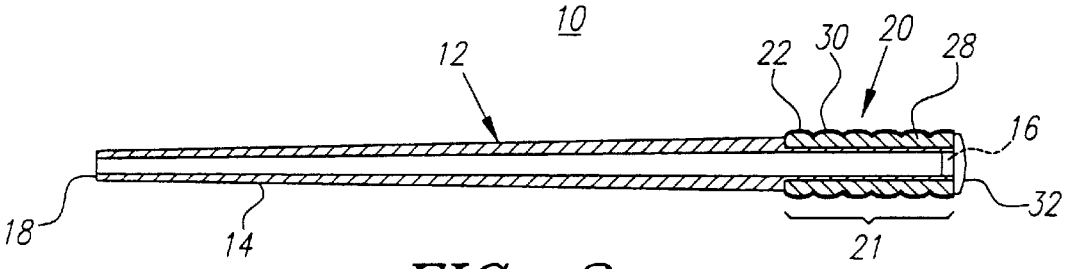
FIG. 2 is a cross-section of the embodiment of FIG. 1, taken along line 2—2.

Turning to FIG. 2, a cross-section of the shaft body 12 is shown. The shaft body 12 may be manufactured from a plurality of plies of pre-preg composite sheet 14 arranged in a predetermined manner to provide a desired structural design and weight for the shaft 10. The proximal region 21 may comprise a plurality of plies of pre-preg composite sheet 28 similar to those used elsewhere in the shaft body 12, although preferably, plies having a low modulus will be used. Plies of pre-preg composite sheet having a relatively low modulus are generally preferred for the grip 20 because they provide a finished surface having a lower durometer or hardness factor. In addition to plies of pre-preg, the plies 28 may comprise resin films co-molded with the pre-preg plies 14. The resin film may include a rubber, urethane, or epoxy (IPNs) film, possibly including a reinforcing matrix of fibers, such as glass, carbon, kevlar, or similar fibers impregnated in resin, which may exhibit a relatively soft, rubber-like feel for the grip 20. A resin film of EPDM co-polymer is presently preferred.

In addition, the outer surface 22 of the grip 20 preferably may include a coating 30, which may provide additional comfort, vibration dampening and/or slip resistance. The coating 30 generally comprises a sprayed or dipped material which cures into a substantially soft, resilient surface finish for the grip 20. The coating 30 preferably has a finished thickness of about 0.005 inches to about 0.030 inches.

Akzo Nobel Coatings, Inc. of Troy, Mich. manufactures a two component coating system called DURASOFT (Part Nos. 4BLU44656A (resin), and 10AHU43555 (activator)) which provides a satisfactory coating material for the present invention. Resin and activator are mixed in a five-to-one ratio to make the coating. The coating is either sprayed onto the grip 20, or, preferably, the grip 20 is dipped into a container of the coating. The ratio of resin and activator may be adjusted if a different feel is desired for the finished surface. For example, if greater "tack" or flexibility in the finished coating is desired, less activator may be mixed with the resin. Sherwin Williams of Cleveland, Ohio also makes a coating, SOFT SWADE Series G57, which may be used to coat grips in accordance with the present invention. Other similar commercial products may also provide the desired soft feel and slip resistance needed for a finished grip.

Figure 3:
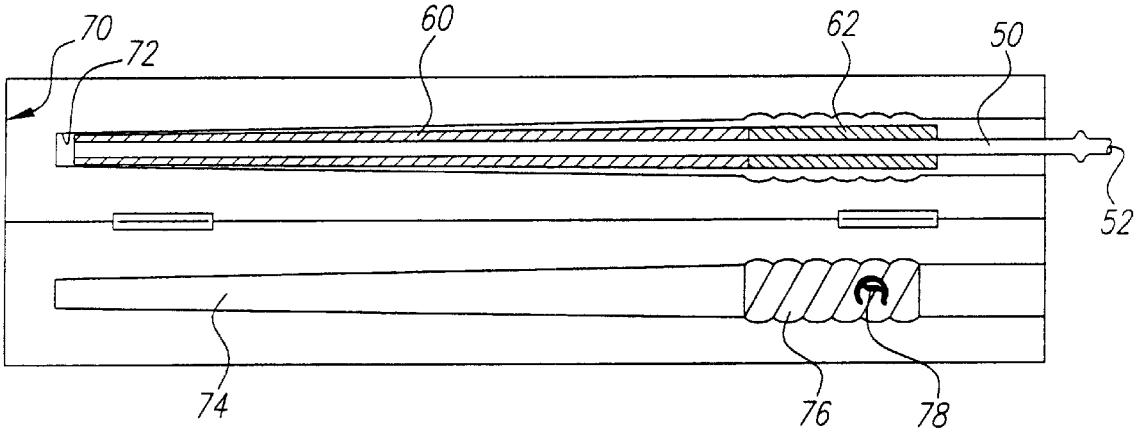
FIG. 3 is a top view of a ply-wrapped mandrel inserted into a curing mold that may be used in a preferred method of manufacturing a shaft with an integral grip.

Referring now to FIG. 3, an apparatus for manufacturing shafts in accordance with the present invention is partially shown. A mandrel 50, generally comprising an elongated generally tapered member, is provided, and covered by a flexible bladder (not shown). The bladder is preferably formed from latex or silicon, although other materials may also be used. A plurality of plies of pre-preg composite sheet 60,62 are wrapped, preferably manually, around the latex covered mandrel 50 in a predetermined manner, Preferably, the plies 62 used in the grip region 20 of the shaft 10 will have a relatively low modulus compared to the plies 60 used in the remainder of the shaft 10. The ply-wrapped mandrel 50 is placed in a mold 70, having a wall 72 which defines a cavity 74 having a desired shape for the finished shaft. The cavity 74 includes a grip region 76 defining a geometric pattern for a grip, and includes a recessed pattern 78 (or alternatively a protruding pattern, not shown) which may be embossed (or alternatively imprinted) onto the plies 62.

If desired, the mandrel 50 may be removed from the core of the plies 60, 62 and a source of pressurized gas 52 may be sealably connected to the bladder. Preferably, the mandrel 50 remains within the plies 60, 62, and the source of pressurized gas 52 is connected to the mandrel 50. The bladder (not shown) is inflated to a predetermined pressure, preferably between about 100 psi and 300 psi, by introducing the gas through the mandrel 50 and/or directly into the bladder. This forces the plies 60, 62 of pre-preg against the wall 72 of the mold 70. The mold 70 is heated to a predetermined temperature, preferably between about 250° F. and 800° F. depending upon the resin used, for a time sufficient to allow the resin in the plies 60 to fully cure. The time required for curing may range from about a few minutes (for example, in the case of "quick cure" epoxies or thermoplastic resins) to 1.5 hours. Thereafter, the cured plies now forming a shaft may be removed from the mold 70. The mandrel 50 (if not previously removed) is removed from the core of the shaft, and the bladder (not shown) is removed.

The shaft 10 is then ready to be finished (e.g. painted and/or silk screened) and incorporated into a finished device, such as a golf club or a fishing pole. If desired, the integrally molded grip 20 may provide a finished grip 20 for the shaft 10. Alternatively, the shaft 10 may then be primed or provided with a conventional finish, and a conventional cap or plug 32 may be inserted into the proximal end 16 of the shaft body 12 (see FIG. 1). Preferably, however, the grip 20 may be coated with a soft, slip resistant coating, as previously described. The coating may be applied directly onto the grip 20 without any surface preparation, or alternatively, the surface 22 of the grip 20 may be scrubbed lightly, such as with steel wool, prior to being coated.

Standard weight shafts having integral grips in accordance with the present invention will weigh about 60–70 grams or less, as the materials included to define the grips generally weigh less than about 5–8 grams. In contrast, conventional standard weight shafts with traditional grips weigh about 115–120 grams (about 45–50 grams of which is from the grip). Similar reductions in weight may be achieved for ultra-light shafts. However, the weight reduction may not be as substantial where ultra-light grips (having a mass on the order of 20 grams) are employed. Thus, the present invention allows for finished golf clubs weighing as little as about 255 grams, substantially less than the 300 grams achievable with prior art composite golf clubs using traditional grips.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method of manufacturing a light-weight shaft having a grip integrally molded thereon, the method comprising:

providing a mandrel covered by a flexible bladder having a proximal end, a distal end, and a proximal region;

wrapping a plurality of plies of pre-preg composite sheet defining a shaft body around the mandrel, the plurality of plies including a first plurality of plies of pre-preg and a second plurality of plies of pre-preg, the second plurality of plies of pre-preg co-molded with resin films of EPDM co-polymer and having a lower durometer than the first plurality of plies being wrapped around the proximal region of the mandrel defining an integral grip of the shaft body, placing the wrapped mandrel in a mold, the mold having a wall defining a cavity, the cavity including a grip region defining a grip geometry;

introducing pressurized gas through the mandrel to inflate the bladder to a predetermined pressure forcing the plurality of plies of pre-preg against the walls of the mold and heating the wrapped mandrel for a sufficient time to allow the plurality of plies of pre-preg composite sheet to cure, and to allow the second plurality of plies to co-mold with the resin film thereby forming the grip geometry of the grip region;

removing the shaft from the mold and applying a coating to the proximal plies of the grip region such that the outer surface of the grip region has a finished thickness of from about 0.005 inch to 0.030 inch; and the finished weight of the shaft is less than 70 grams.

* * * * *